United States Patent [19]

Fasano et al.

[11] 4,410,112

[45] Oct. 18, 1983

[54] DEVICE FOR REGULATING A TUNDISH STOPPER

[75] Inventors: Fulvio Fasano, Gorizia; Giorgio Turco, Pozzuolo del Friuli, both of Italy

[73] Assignee: Danieli & C. Officine Meccaniche S.p.A., Italy

[21] Appl. No.: 267,058

[22] Filed: May 26, 1981

[30] Foreign Application Priority Data

May 26, 1980 [IT] Italy ..... 60384/80[U]

[51] Int. Cl.[3] ..... B22D 41/08

[52] U.S. Cl. ..... 222/602; 222/509; 222/559

[58] Field of Search ..... 222/602, 509, 559

[56] References Cited

U.S. PATENT DOCUMENTS

| | | | |
|---|---|---|---|
| 2,493,594 | 1/1950 | Reed | 222/602 |
| 2,531,556 | 11/1950 | Davis et al. | 222/602 |
| 3,627,180 | 12/1971 | Montgomery | 222/602 |

FOREIGN PATENT DOCUMENTS

| | | | |
|---|---|---|---|
| 511102 | 11/1953 | Belgium | 222/602 |
| 41051 | 12/1981 | European Pat. Off. | 222/602 |
| 520017 | 3/1931 | Fed. Rep. of Germany | 222/602 |
| 825586 | 12/1951 | Fed. Rep. of Germany . | |
| 1269297 | 5/1968 | Fed. Rep. of Germany | 222/602 |
| 2319004 | 10/1974 | Fed. Rep. of Germany . | |

*Primary Examiner*—David A. Scherbel

*Attorney, Agent, or Firm*—Stevens, Davis, Miller & Mosher

[57] ABSTRACT

This invention concerns a device for regulating a tundish stopper, whereby the stopper (I2) submerged in the tundish (I0) is connected rigidly (I3) to a substantially parallel shaft (I5) moving parallel to said stopper (I2), and whereby the substantially parallel shaft (I5) has a tract with a rack (I8) cooperating with a toothed sector (I9) having a lever (20), and whereby a reaction slide block (25) cooperates in a coordinated manner with the toothed rack tract (I8), and whereby there is present an axially movable sleeve (27) which can be clamped (33) to said shaft (I5) and which cooperates with a threaded ring nut (34) performing axial adjustment, and whereby it is possible to mechanise either the toothed sector (I9) or the movable sleeve (27) or both of them (I9–27).

5 Claims, 3 Drawing Figures

DEVICE FOR REGULATING A TUNDISH STOPPER

This invention relates to a device to regulate a tundish stopper. To be more exact, this invention relates to a device to operate the regulating of the position of the stopper which regulates the teeming of molten metal through the pouring nozzle of a tundish.

Continuous casting plants are known. It is known that the molten metal is usually discharged from a ladle into a tundish and is teemed continuously from the tundish into an appropriate ingot mold.

So that there can be a correlation between the quantity of metal leaving the tundish and the quantity required by the ingot mold, a stopper is employed which is immersed in the molten metal and which also serves to shut the pouring nozzle so as to stop the flow at any desired moment.

It is known that the stopper is driven axially and that the accuracy of its control determines the outcome of the operation. The precision of the control is important since fine or minute regulation may be necessary, depending on the casting. In fact, in some cases even small variations in the flow have a considerable effect on the unitary volume of the ingot mold and affect the quality appreciably, causing severe problems with regard to the risk of the molten metal overflowing.

According to the invention the stopper is connected rigidly to a substantially parallel shaft which bears a rack in an intermediate position. The shaft is guided substantially at its ends and includes a support relative to the zone comprising the rack.

Furthermore, for protective reasons a removable upper cover is envisaged which is technically insulated and can be extracted from its anchorage means.

The guides and supports for the guided shaft are supported on a plate applied to the tundish in such a way that it can be dismantled.

A toothed sector connected to a shaft cooperates with the rack, and the toothed sector serves to carry out the rough adjustment of the position of the stopper in relation to the outlet nozzle.

When rough adjustment has been carried out, an outwardly threaded sleeve connected to a controlling ring nut is clamped to the shaft parallel to and solidly connected to the stopper. If the ring nut is rotated, it is possible to move the sleeve axially even micrometrically and therewith it the parallel shaft and the stopper.

In fact, to the axial displacement of the parallel shaft there corresponds an equal axial displacement of the stopper in the same direction.

Mechanization of the regulating movement also lies within the spirit of the invention.

The mechanization can act on the toothed sector or on the axial sleeve or on both.

According to the invention the mechanization device envisages connection means or coupling means suitable for independent connection during automatic operation, and means for switching off the mechanization device during operation by hand.

The invention, therefore, is a device to regulate a tundish stopper, whereby the stopper is immersed in the tundish and is rigidly connected to a substantially parallel shaft moving parallel to the stopper. The substantially parallel shaft includes a tract with a rack cooperating with a toothed sector having a lever. The device is characterized by comprising in coordinated cooperation with the rack-wise toothed tract a reaction slide block, whereby a movable sleeve is present which can be clamped on the shaft and which cooperates with a threaded ring nut carrying out axial regulation, and whereby it is possible to mechanize either the toothed sector or the movable sleeve or both of them.

Other details and features of the invention will stand out from the description given below by way of non-limitative example and with reference to the accompanying drawings, in which.

Figures 1, 3:
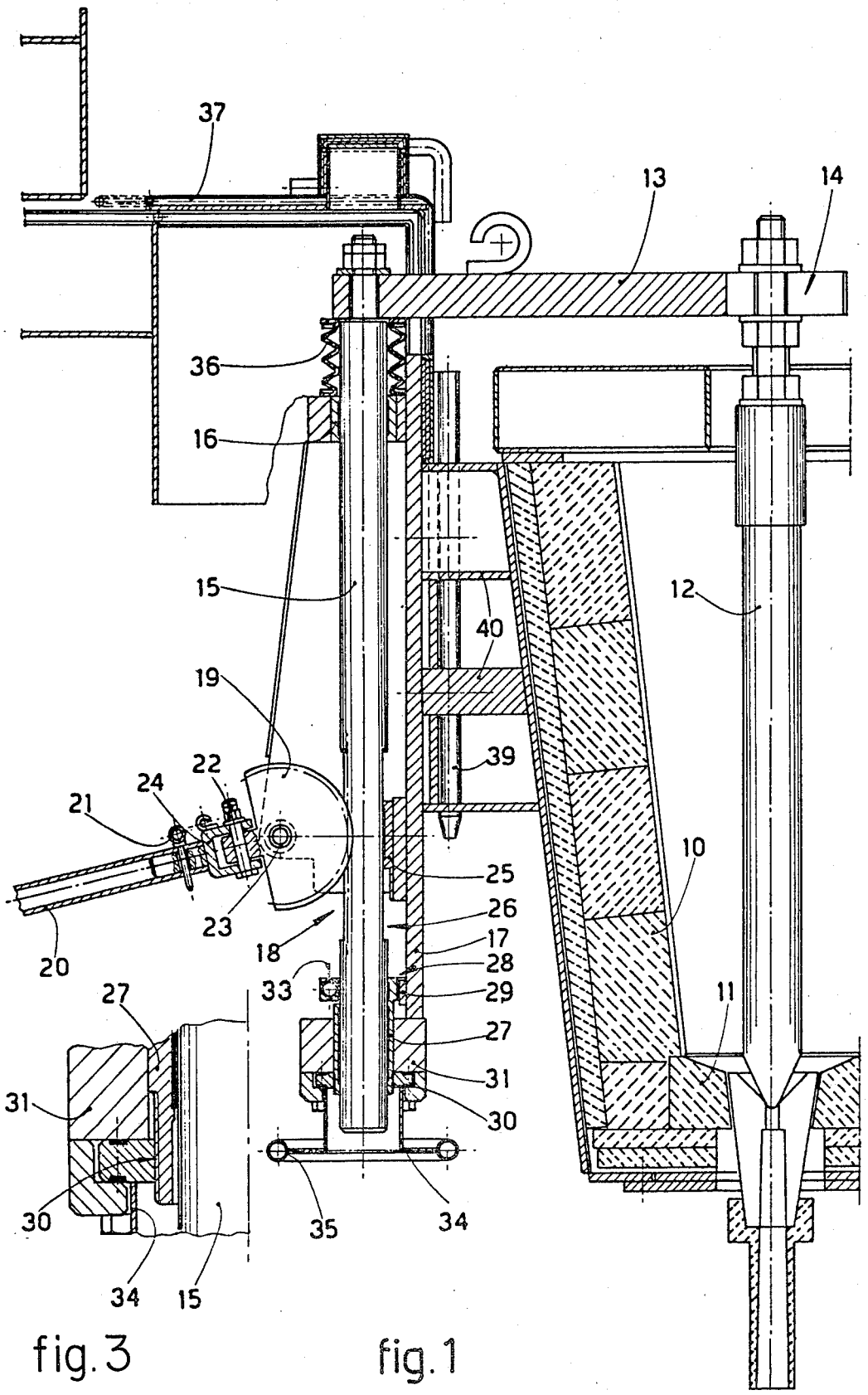
FIG. 1 shows an upright section of the invention from its side.
FIG. 3 shows an enlarged segment of the apparatus for finely adjusting the position of the stopper.

With reference to the figures, the tundish 10 has the outlet nozzle 11 with which the stopper shaft 12 cooperates. The stopper shaft 12 is clamped to the rigid arm 13, advantageously within a slot 14 for sideways adjustment. At the other end of the arm 13 is anchored the substantially parallel shaft 15.

The substantially parallel shaft 15 is guided at its upper end by a sleeve 16 upheld by the plate 17 screwed onto the tundish 10.

In a suitable position there is a tract provided with a rack 18 cooperating with a toothed sector 19, which can rotate on its axle 23 and which is connected by the fork 24 to a rod 20 able to reduce the effort of operation by hand.

The fork 24 is connected to the toothed sector 19 by means of a bolt 22 and nut, which permit the rod to lie at a given sideways angle so as to facilitate action by the operator. The fork 24 is connected to the rod 20 with a gudgeon 21 for the purpose of easy replacement A reaction slide block 25 on the plate 17 cooperates with the rack tract 18. In the eample shown, the block 25 and the reaction surface 26 are flat but could also be oval, round, etc.

The reaction slide block 25 can be replaced and serves to obviate bending of the shaft 15 and, therefore, serves to maintain a good mechanical connection between rack 18 and toothed sector 19, thereby improving the manoeuverability and life thereof.

The reaction slide block 25 has an upper layer made of a wear-resistant material. The material can be of a plastic type, known commercially under the name of Rulon-LD.

According to the invention a mechanization organ, such as a geared motor, step motor or other type, can be visualized as being on the same axis as the toothed sector 19 and therefore with the axle 23. This mechanization organ can include a clutch that actuates the mechanical connection with the toothed sector 19 only if the mechanization organ is activated, or which cuts off the mechanical connection with the toothed sector 19 when the operator is acting manually.

Instead of the clutch there can be envisaged a coupling, a thrust-type circuit-closing switch, etc., this being unimportant for the purposes of the invention. Thus it is possible to visualize a mechanization organ always engaged with a split ring (of the type such as shown by the reference 33) which can be clamped, as required, by the operator on the axle 23.

In the lay-out shown, the lower end of the shaft 15 slides in a movable sleeve 27. The movable sleeve 27 is guided axially by the support 31 solidly fixed to the plate 17 and cooperates with a guide 29 in the tract 28. The guide is able to obviate the possibility of the rotation of the movable sleeve 27. Indeed the movable sleeve 27 has to be able to move axially but must not be able to rotate.

Figure 2:
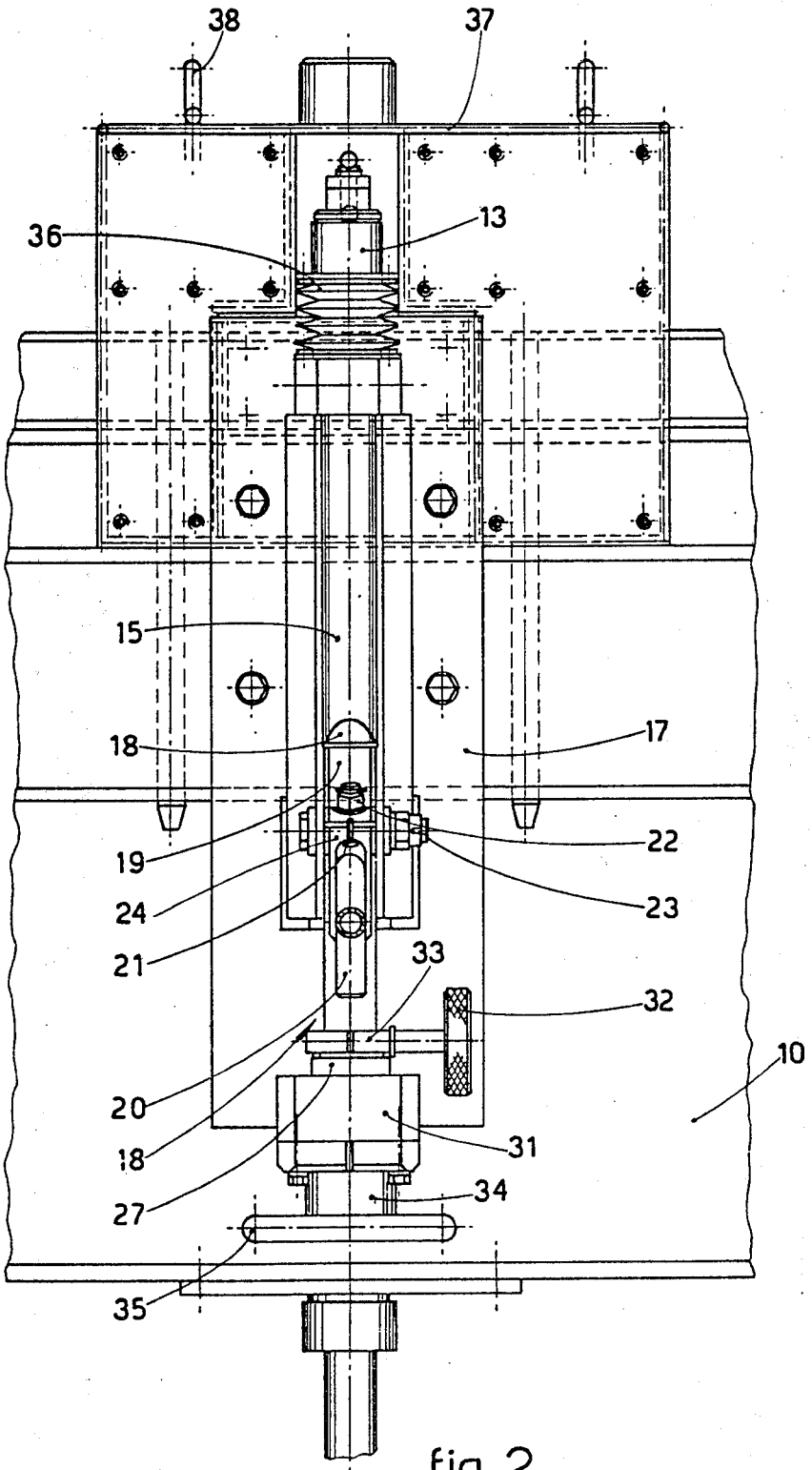
FIG. 2 shows the lay-out of FIG. 1 from its front.

The movable sleeve 27 includes a split half-ring 33 (FIG. 2), which can be clamped by operating the handwheel 32. When the split half-ring 33 is clamped, it is anchored on the substantially parallel shaft 15 and becomes solidly fixed thereto.

The sleeve 27 also comprises a threaded tract 30 (FIG. 3) which cooperates with a threaded ring nut 34 unable to move axially but able to rotate owing to the action of the handwheel 35 solidly fixed to the ring nut 34. By acting circumferentially, therefore, on the handwheel 35, the ring nut 34 is made to rotate and cause axial displacement of the sleeve 27.

If the sleeve 27 has the half-ring 33 clamped by means of the handwheel 32 on the shaft 15, when the ring nut 34 is made to rotate, the sleeve 27 is displaced thereby, as also is the shaft 15.

By the coordinated cooperation of the ring nut 34 with the sleeve 27 it is possible to move the shaft 15 and, therewith, the stopper 12 micrometrically, thus obtaining and maintaining a very fine adjustment.

According to the invention a mechanization organ, such as a geared motor, step motor or other type, can be placed on the same axis as the ring nut 34 or sideways thereto and cooperating therewith through transmission means. The mechanization organ can be disconnected or is capable of being disconnected as required by means of a clutch, coupling or circuit-breaking switch, or else by means of a split ring of the type such as shown by the reference 13. In this way the mechanization organ can be connected or disconnected as wished.

According to the invention mechanization organs can cooperate with both the actuation means 19 and 34, and can be linked to hand controls or automatic controls, or be connected to automatic devices monitoring the level of mold metal in the ingot mould or to controls governing the halting or ending of casting.

The upper part of the shaft 15 is protected by a bellows 36 and is enclosed in the insulated shield 37 which can be removed by being pulled out. The removable shield 37, together with its insulation, shelters the operators and is equipped with top links 38 for its removal. Removal is carried out by lifting the screen 37 from above so that the pins 39 solidly fixed to shield 37 come out of the guides in the supporting structure 40 of the plate 17.

A preferential solution has been described, but variants are possible. Thus it is possible to vary the proportions and sizes, or to add, remove and embody parts. The parts can be arranged in other sequences.

These and other variants are all possible for a technician in this field without departing from the scope of the invention.

We claim:

1. A device for regulating a tundish stopper on a first shaft comprising a support structure for said tundish, a rigid arm attached at one end to said first shaft, a second shaft connected to the other end of said arm and positioned parallel to said first shaft, said second shaft defining a rack, a toothed sector meshing with said rack, a lever connected to said toothed sector for movement thereof, a reaction slide block slidable with respect to said second shaft positioned opposite said toothed sector, an externally threaded sleeve on said second shaft axially movable with respect to said second shaft, and a threaded ring nut positioned on said sleeve which when rotated causes the sleeve and second shaft to move longitudinally.

2. The device of claim 1 including a connecting means between said lever and said tooth sector, said connecting means comprising a laterally revolvable fork.

3. The device of claim 1 or claim 2 wherein said reaction slide block is of a plastic wear resistant material.

4. The device of claim 1 or claim 2 including a clamping means and guide for said sleeve, said clamping means being utilizable to clamp said sleeve to said second shaft and comprising a split half-ring and a hand wheel, said movable sleeve being displaceable only axially along said second shaft.

5. The device of claim 1 including a shield to protect the operator connectable to said support structure.

* * * * *